United States Patent [19]

Savard et al.

[11] 4,336,064

[45] Jun. 22, 1982

[54] METHOD OF IMPROVING THE PERFORMANCE OF SUBMERGED OXYGEN INJECTORS

[75] Inventors: Guy Savard, Westmount; Robert G. H. Lee, Montreal, Canada

[73] Assignee: Canadian Liquid Air Ltd., Montreal,both of Canada

[21] Appl. No.: 194,623

[22] Filed: Oct. 6, 1980

[51] Int. Cl.[3] ..... C21C 5/34

[52] U.S. Cl. ..... 75/60; 75/51; 75/52; 75/59

[58] Field of Search ..... 75/51, 52, 59, 60

[56] References Cited

U.S. PATENT DOCUMENTS 3,932,172 1/1976 Knuppel ..... 75/60

FOREIGN PATENT DOCUMENTS 1450718 7/1966 France ..... 75/60

*Primary Examiner*—Peter D. Rosenberg

*Attorney, Agent, or Firm*—Bachman & La Pointe

[57] ABSTRACT

In the injection of oxygen through a refractory lined wall into a molten metal, for example, pig iron, the injected oxygen is surrounded by a stream of a protective fluid to diminish erosion of the refractory lining; the velocities of the oxygen and protective fluid are selected to minimize eddying of the oxygen into the protective fluid so that the protective fluid retains its effectiveness for a greater distance from the injector whereby greater protection is provided to the injector and the refractory.

5 Claims, No Drawings

METHOD OF IMPROVING THE PERFORMANCE OF SUBMERGED OXYGEN INJECTORS

BACKGROUND OF THE INVENTION (i) Field of the Invention

This invention relates to metal refining in a molten metal bath into which oxygen is injected.

(ii) Description of the Prior Art

U.S. Pat. No. 3,706,549, the teaching of which is hereby incorporated herein by reference, describes the injection of oxygen into a bath of molten metal from below the bath surface in the refining of pig iron to steel, such that accelerated erosion of the refractory used to line the container of the bath, is prevented.

The oxygen injector which extends through the refractory wall lining of the container, comprises two concentric tubes. The inner tube is used for injection of oxygen gas and the annular space between the inner tube and the outer tube is for applying a protective fluid. The fluid, which is usually a hydrocarbon, is employed to shield the oxygen from the reactive molten metal at the interface of the refractory wall and the molten metal and ensures that the vigorous reaction with the molten metal takes place away from the refractory wall.

The resultant delay in the exothermic reaction between the oxygen and the molten metal is sufficient to maintain the integrity of the refractory wall.

The prior art teaches that the effectiveness of the hydrocarbon protective fluid shield is due to its endothermic decomposition under the high temperature conditions existing in the molten metal bath.

Although use of the method of the U.S. Patent results in an overall improvement, particularly in the life of the refractory, the injector is still subject to erosion and it is desirable to further improve the life of the refractory lining.

It is an object of this invention to improve the life of an injector and of the refractory lining employed in a method of the kind described in U.S. Pat. No. 3,706,549.

SUMMARY OF THE INVENTION

According to the invention there is provided in a method of injecting oxygen into a bath of molten metal, in the refining of said metal, in which the oxygen is injected in a stream into the molten metal from below the upper surface thereof and in which the injected oxygen is surrounded by a simultaneously injected stream of protective fluid, the improvement wherein the relative velocities of injection of the oxygen and protective fluid are selected to substantially minimize turbulence between the streams.

DESCRIPTION OF THE PREFERRED EMBODIMENTS

It has now been found that an important feature of the protective fluid, for example, the hydrocarbon, is its scavanging capability for oxygen. By scavanging the oxygen from the central stream which eddies into the protective annular fluid envelope, the protective fluid is effective in preventing the oxygen and molten metal reaction from taking place at the refractory/molten metal interface and at the molten metal/injector interface.

Since the scavanging effect is important for extending the life of the injector and refractory surrounding the injector, is has now been found that it is important to design the injector so that the turbulent conditions between the central oxygen stream and the annular protective stream are minimized, thereby minimizing the oxygen eddying and the migration of oxygen into the protective stream with mixing of oxygen and the protective stream. In this way it is possible to retain the effectiveness of the protective stream for a significant distance from the injector outlet and hence to provide greater protection of the injector and refractory, and thus longer life in these parts.

It has been found that a major factor assisting in retaining the integrity of the protective annular stream and thereby reducing the eddying or turbulence between the streams is their relative velocities at the exit of the injector.

In order to obtain the maximum protection with the minimum amount of protective fluid, the relative velocity of the central oxygen stream must be as low as possible. For the most efficient range the velocity of the protective fluid stream should be about 0.5 to 1.5 of the velocity of the oxygen stream as the streams leave the injector and enter the molten metal.

The velocity difference parameter is more critical in the case of a non-oxygen scavanging protective fluids, such as $N_2$, $SO_2$, $H_2O$ $CO_2$ and argon. The larger the deviation from the condition where minimum eddies are formed, the larger the amount of protective fluid required to maintain the integrity of the injector and the surrounding refractory.

We claim:

1. In a method of injecting oxygen into a bath of molten metal, in the refining of said metal, in which the oxygen is injected in a stream into the molten metal from below the upper surface thereof and in which the injected oxygen is surrounded by a simultaneously injected stream of protective fluid, the improvement wherein the velocity of the stream of protective fluid is about 0.5 to 1.5 times the velocity of the oxygen stream at the point of injection, whereby turbulence between the streams is substantially minimized.

2. In a method of injecting oxygen into a bath of molten metal, in the refining of the metal, in which the oxygen is injected in a stream into the molten metal from below the upper surface thereof and in which the stream of oxygen is surrounded by a stream of a hydrocarbon, the improvement wherein the velocity of the stream of hydrocarbon is about 0.5 to 1.5 times the velocity of the oxygen stream at the point of injection, and said hydrocarbon stream scavenges oxygen which eddys into the hydrocarbon stream to prevent the oxygen and molten metal reacting, with a minimum of turbulence between the streams.

3. A method according to claim 1, wherein said metal is pig iron and said fluid is selected from the group consisting of $N_2$, $SO_2$, $H_2O$, Ar, $CO_2$ and a hydrocarbon.

4. A method according to claim 1 wherein said metal is pig iron and said fluid is a hydrocarbon.

5. A method according to claim 1, wherein said molten metal is selected from the group consisting of lead, tin, nickel, cobalt and copper.

* * * * *